United States Patent [19]

Kirchen et al.

[11] Patent Number: 4,911,595

[45] Date of Patent: Mar. 27, 1990

[54] APPARATUS FOR LINING THE INSIDE WALL OF A VESSEL WITH BRICKS

[75] Inventors: Michel Kirchen; Victor Kremer, both of Luxembourg; Emile Lonardi, Bascharage; Corneille Melan, Luxembourg, all of Luxembourg

[73] Assignee: Paul Wurth S.A., Luxembourg

[21] Appl. No.: 277,363

[22] Filed: Nov. 29, 1988

[30] Foreign Application Priority Data

Nov. 30, 1987 [LU] Luxembourg ..... 87054

[51] Int. Cl.[4] ..... E04G 21/22

[52] U.S. Cl. ..... 414/10; 187/9 E; 266/281; 414/790.7

[58] Field of Search ..... 187/9 E; 266/281; 414/10, 792.9, 790, 790.7, 796.9; 52/747, 749

[56] References Cited

FOREIGN PATENT DOCUMENTS

| | | |
|---|---|---|
| 0226075 | 6/1987 | European Pat. Off. . |
| 1434761 | 5/1976 | United Kingdom . |
| 1434762 | 5/1976 | United Kingdom . |
| 2189462 | 10/1987 | United Kingdom . |

*Primary Examiner*—Robert J. Spar
*Assistant Examiner*—Janice Krizek
*Attorney, Agent, or Firm*—Fishman, Dionne & Cantor

[57] ABSTRACT

An apparatus for lining the inside wall of a vessel with bricks is presented. The apparatus includes a work platform, a handling robot and telescopic hoists. The telescopic hoists have carriages for receiving a stack of bricks of the same type. At the platform level, a vertical conveyor is associated with the hoists. The vertical conveyor transfers the stack of bricks from the carriages and raise the bricks to the platform level. The installation of this invention is particularly useful for laying a refractory lining on the inside wall of a metallurgical converter.

7 Claims, 4 Drawing Sheets

Fig. 4
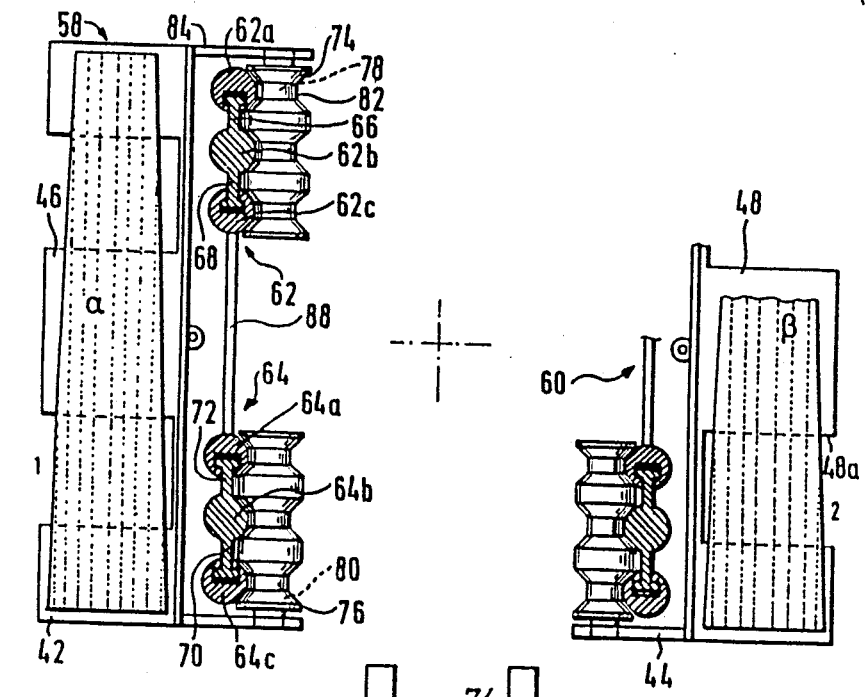
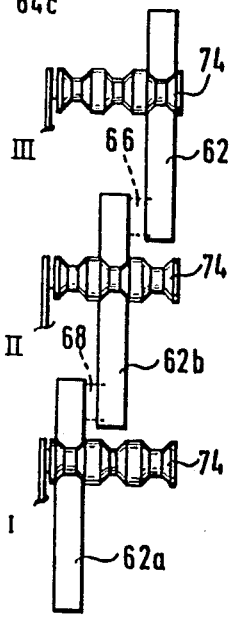
Fig. 5
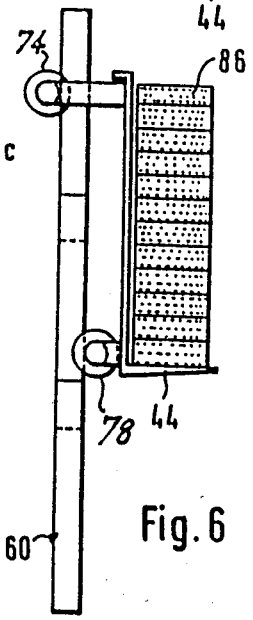
Fig. 6

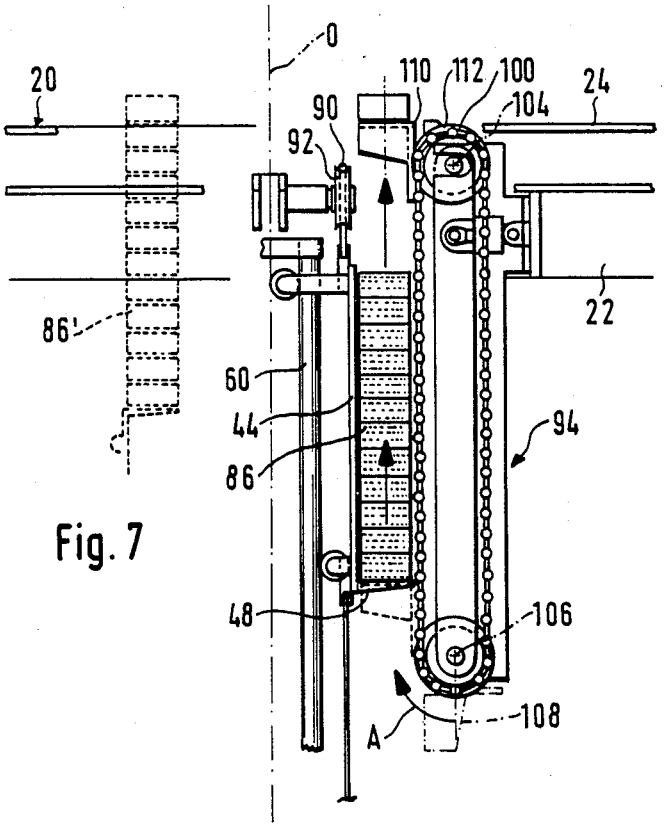
Fig. 7
Fig. 8
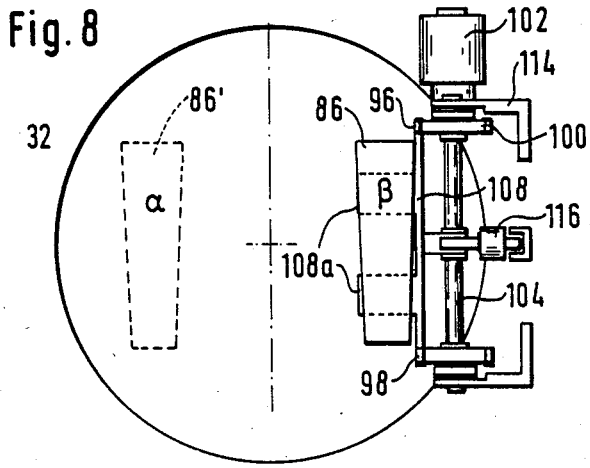

APPARATUS FOR LINING THE INSIDE WALL OF A VESSEL WITH BRICKS

BACKGROUND OF THE INVENTION

The present invention relates to an automated apparatus for lining the inner wall of a vessel with bricks. More particularly, the present invention relates to a brick laying apparatus comprising a work platform which is vertically movable within the vessel and capable of rotating about the vertical axis of the latter. The work platform is provided with at least one hoist comprising a plurality of telescopic sections. Carriages, for lifting the bricks, run along the length of the hoist. The carriages transport bricks from a depalletization station situated at the foot of the hoists to the level of the platform. A depalletization robot is included which transfers the bricks from a reserve of pallets to the carriages which run along the hoists. Also included are a supervision cabin, and a robot for handling and laying the bricks.

Although not being limited thereto in its utility, the present invention is aimed more particularly at an apparatus for laying a refractory lining on the inner wall of a metallurgical converter.

Various robotized apparatus of this type (see for example, German Patent Document No. DE-A1-3710009 corresponding to U.S. Pat. No. 4,765,789, all of the contents of which are incorporated herein by reference) have already been proposed. In this known apparatus, the carriages of the hoists carry two bricks, or at most two pairs of bricks. The bricks may be of two different types if the handling robot is designed for laying a pair of superimposed bricks in each operation. This requires that the two carriages make numerous forward and return trips along the hoist. These trips must be made at a very rapid rate to follow the working rhythm of the handling robot, which presents problems as the hoist progressively rises to brick up the top part of the converter. Also, each carriage must bring the brick, or the two bricks, down again, if the brick or bricks are not of the type required by the handling robot at the moment of laying. This results in heavy stresses on both the drive and guide means. These stresses are particularly heavy as the bricks are laid on the carriage in a direction which exert a relatively high moment on the guide rollers.

SUMMARY OF THE INVENTION

The above discussed and other problems of the prior art are overcome by the brick laying apparatus of the present invention. The bricklaying apparatus of the present invention is designed in a manner in which the hoist or hoists are less highly stressed. This decreased stress results from a reduction of trips made by each carriage, without reducing the working rate of the handling robot.

In accordance with the present invention, the reduction of the trips of each carriage is achieved by providing each carriage with a carrier tray intended to receive a stack of bricks (the bricks being all of the same type). In addition, each hoist has associated with it, at the level of the platform, a vertical conveyor. The conveyor is intended to take the stack of bricks from the carriage and to raise it to the level of the platform so it is within the reach of the handling robot.

Each vertical conveyor may be composed of two endless chains connected by a fork elevator. The teeth or forks of the fork elevator are so disposed and designed to enable free passage through corresponding cutouts in the tray of the carriage of the associated hoist.

The carriages and the vertical conveyors preferably receive a dozen bricks stacked one on the other. However any number of bricks, which is a multiple of the brick capacity of the carriages, may also be stacked on the carriages. This multiple will depend on the brick capacity of the pallets.

An important feature of the present invention is the intermediate storage of bricks on the vertical conveyors. This storage enables the handling robot to always have available a reserve of bricks of each of the two types. When a stack of bricks has been transferred from the carriage to the vertical conveyor, the carriage has sufficient time to pick up a new stack of bricks from the depalletization station. Because each of the carriages can carry up to twelve bricks or more, the carriages will have fewer trips to make in comparison with the known prior art apparatuses. This improvement is accomplished without decreasing the working rate of the handling robot.

The bricks are laid onto the carriages in a longitudinal direction (i.e. parallel to the general plane of the hoists). This reduces the force couple exerted by the weight of the bricks and decreases the stresses on the hoists.

The endless chains of each vertical conveyor are driven by a stepping motor. The motor periodically operates the conveyor in a manner to turn the chains, on each stop, over a length which corresponds to the thickness of one or two bricks.

Each vertical conveyor may be mounted in a manner which allows it to pivot slightly about the axis of the bottom return sprockets of the endless chains. This enables it to be slightly inclined in a direction which prevents the bricks from falling off.

Each hoist may be provided with two groups of adjacent telescopic rails which have a circular cross-section. The individual rails of each group fit into one another by profiled lateral lugs. The lugs are provided on one or more rails and slide into corresponding profiled guide slots in the other rails of the same group.

Each carriage is provided with top rollers which run along the groups of rails on the side remote from the carriage; and with bottom rollers which run along the groups of rails on the carriage side.

Rather than using two separate hoists, it is also possible for two carriages to run, one on each side of the same group of telescopic rails. This carriage arrangement reduces the horizontal dimensions of the apparatus. It also reduces the size of the opening required in the platform.

The above-discussed and other features and advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGURES:

FIG. 4 is a horizontal cross-sectional elevational view of an alternate embodiment of the hoists and carriage of FIG. 2;

FIG. 5 is a diagram which illustrates the movement of the carriage along the hoists of FIG. 4;

FIG. 6 is a diagram which illustrates the manner in which the carriages are attached to the hoists of FIG. 4;

FIG. 7 is a partial side elevational view of a vertical conveyor of the apparatus of FIG. 1; and FIG. 8 is a partial top elevational view of the vertical conveyor of FIG. 7.

DESCRIPTION OF THE PREFERRED EMBODIMENT

Figure 1:
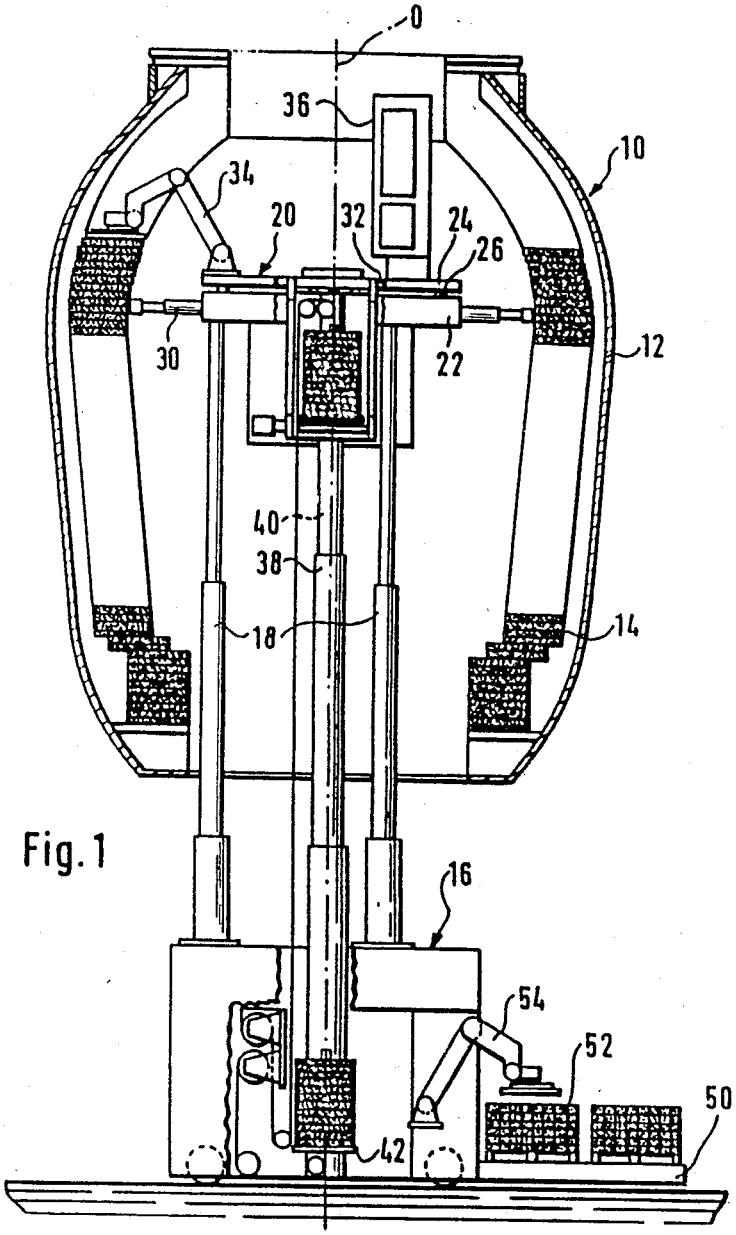
FIG. 1 is a front elevational view of an apparatus for lining the inner wall of a converter with bricks in accordance with the present invention.

FIG. 1 shows a metallurgical converter 10 which consists of a metal body 12 and an internal refractory lining 14 which has to be periodically replaced. A support 16 carries the bricklaying apparatus, and is mounted on wheels for mobility. A plurality of telescopic masts 18 are provided on support 16. Masts 18 support a platform 20. Masts 18 are designed to move platform 20 by either extension or retraction along the vertical axis 0 of converter 10. Platform 20 is composed of a fixed circular support 22 on which, with the interposition of a bearing 26, a table 24 rests. Table 24 is provided with a centrally located opening 32. Table 24 is adapted to turn about vertical axis 0 through the action of a motor (not shown). Platform 20 is also provided with a plurality of retractable radial props 30. Props 30 ensure the horizontal stability of platform 20 by bearing against the refractory lining 14 of converter 10. On platform 20 is disposed a refractory brick handling and laying robot 34. Also situated on platform 20 is a cabin 36 which is intended to shelter a person supervising the bricklaying.

Support 16 also carries two hoists 38 and 40 (hoist 40 being hidden in FIG. 1 by hoist 38). Hoists 38 and 40 are attached at their top ends to platform 20. The telescopic nature of hoists 38 and 40 allow them to follow the vertical movement of platform 20. Carriage 42 and 44 travel along each hoist 38 and 40. Each carriage 42 and 44 has a brick support tray 46 and 48.

Support 16 also has a tray 50 which is sufficiently wide to receive up to four pallet loads of bricks 52. At the side of tray 50 is disposed a depalletization robot 54. Robot 54 can be mounted on a rail on support 16 in a manner which enables it to be moved, at right angles to the plane of FIG. 1, along tray 50 in order to gain access to pallets 52.

Figure 2:
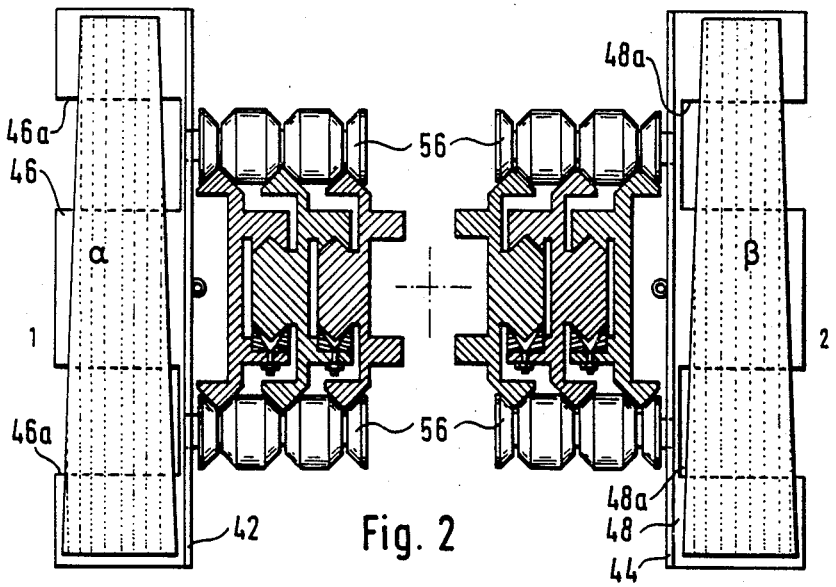
FIG. 2 is a horizontal cross-sectional elevational view of the hoists and carriage of the apparatus of FIG. 1.
Figure 3:
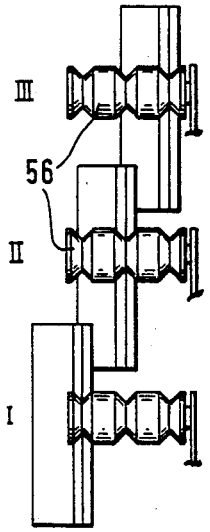
FIG. 3 is a diagram which illustrates the movement of the carriage along the hoists of FIG. 2.

FIGS. 2 and 3 show a first embodiment of construction of telescopic hoists 38 and 40. Each hoist 38 and 40 is composed of three profiled slideways which are identical to those shown in U.S. Pat. No. 4,165,789. Carriages 42 and 44 are provided with top and bottom rollers 56. Rollers 56 run along the sectional members of hoists 38 and 40. Hoists 38 and 40 are provided with circular grooves which cooperate in succession with the different sections of hoists 38 and 40, when the hoists are extended as shown in FIG. 3. However, in contrast to hoists known in the prior art, in which each of the carriages carries bricks of different types, in accordance with the present invention, hoists 38 and 40 each carry bricks of only a single type. For example, carriage 42 carries bricks of the type $\alpha$ and carriage 44 carries bricks of the $\beta$ type. Also, in contrast to the prior art apparatus, the bricks are disposed on carriages 42 and 44 in the longitudinal direction. That is, the bricks are disposed in a manner in which their longitudinal axis is at right angles to the axis of rotation of the rollers. This longitudinal arrangement of the bricks reduces the force couple exerted by the weight of the bricks on hoists 38 and 40. In particular, this brick arrangement reduces the force couple on the guide surface between rollers 56 and the sectional members of the sections of hoists 38 and 40. Furthermore, trays 46 and 48 of carriages 42 and 44 are provided with cutouts **46*a* and 48*a***.

FIGS. 4 and 6 illustrate a second embodiment of construction of hoists 58 and 60. Carriages 42 and 44 are identical to those in the first embodiment and are therefore given the same reference numbers.

Hoists 58 and 60 are identical and symmetrical. Therefore only hoist 58 will be described in greater detail. Hoist 58 is essentially comprised of two groups of rails 62 and 64. There are three rails, **62*a*, 62*b*, 62*c* and 64*a*, 64*b*, 64*c*, for each group of rails. Rails 62 and 64 are telescopic. As shown in FIG. 4, each group of rails 62 and 64 are retracted. Rails 62 and 64 are composed of rods having a circular cross-section. Each of central rails 62*b* and 64*b* is provided with diametrically opposite profiled lugs 66,68 and 70,72. Lugs 66, 68 and 70, 72 are engaged and slide in slots of complimentary shape formed in outer rails 62*a*, 62*c* and 64*a*, 64*c*. It would also be possible to form profiled lugs on the outer rails and corresponding slots in the central rail. The number of telescopic sections may be increased from three to four, five or even more rails. The key feature is that the different sections of each group 62 and 64 should slide mutually in relation to one another as shown in FIG. 5. The different rods are preferably joined by known means, either at the slots or at the profiled lugs. This prevents complete detachment from each adjacent rail when hoists 58 and 60** are extended.

Each carriage is provided with a pair of top rollers 74 and 76 and with a pair of bottom rollers 78 and 80. These rollers have as many peripheral grooves 82 as there are telescopic sections in each group of rails 62 and 64. Therefore, rollers 74, 76, 78 and 80 have three peripheral grooves 82. When hoist 58 is retracted, grooves 82 are all engaged around the circular profiles of each of the rods of telescopic groups 62 and 64. However, when hoist 58 is extended, and when carriages 42 and 44 are moved along hoist 58, grooves 82 of rollers 74, 76, 78 and 80 are guided in succession by the different sections of the telescopic groups 62 and 64 (see FIG. 5). This enables each of grooves 82, of each roller, to always be engaged on at least one of the rods of each group 62 and 64.

Carriages 42 and 44 are connected to these top and bottom rollers by carrier arms 84. Carriages 42 and 44 pass on the outside of outer rods **62*a*, 64*c* of telescopic groups 62 and 64 of hoist 58. However, the top rollers preferably travel along the rails on the side remote from the carriage, while the bottom rollers preferably travel on the carriage side, as illustrated in the case of carriage 44 in FIG. 6. Using this method, the effect of the force couple produced by a pile of bricks 86 carried by carriage 44 automatically holds carriage 44 in position and in engagement with the guide rails. Carriage 44 consequently cannot tilt in the direction corresponding to the dropping of the bricks. To reduce the risk of tilting, trays 46 and 48 of carriages 42 and 44 are slightly inclined towards hoists 58 and 60. The movement of carriages 42 and 44 along hoists 58 and 60** is brought about by the action of a hauling cable. This cable can be driven by previously known prior art means.

The embodiment of FIGS. 4 to 6 offers the advantage over the first embodiment shown in FIGS. 2 to 3 in that the force couple produced by the weight of carriages 42 and 44 tends to hold the rollers on their guide rails. In the embodiment shown in FIGS. 2 and 3, this force couple tends to disturb the contact between the rollers and their sectional members and consequently exerts relatively heavy stresses on hoists 38 and 40 at that point.

Groups 62 and 64 of hoist 58 can be fastened together and therefore stabilized by horizontal cross members 88 which connect rails 62*c* and 64*a*.

Another variation of the embodiment shown in FIGS. 4 to 6, involves carriages 42 and 44 travelling along a single hoist which is identical to one of hoists 58 or 60 illustrated in FIG. 4. For the purpose of illustration, it is sufficient to imagine carriage 44 as being fastened to hoist 58 and travelling along telescopic groups 62 and 64. However, in this case, carriage 44 would have to be carried on the inside by its top rollers, that is, its support arms, (corresponding to arms 84 of carriage 42), would be disposed between inner rails 62*c* and 64*a*. Of course, it is possible to provide at most two connecting cross members 88 at top and bottom between telescopic groups 62 and 64. Also, a stronger hoist must be provided. The advantage of this variation is that a cost savings is made with respect to the size and cost of a second hoist.

FIGS. 7 and 8 show the transfer of bricks onto platform 24 in accordance with the present invention. In FIG. 7, carriage 44 of hoist 60 can be seen in the raised position suspended on its hauling cable 90, which is carried by a pulley 92. In this position, carriage 44 and its stack of bricks 86 are situated facing a vertical conveyor 94. Conveyor 94 is essentially composed of two endless chains 96 and 98, which turn around two pairs of pulleys 100. Either the bottom or top pulleys of these pairs are being operated by an electric stepping motor 102. Pulleys 100 are carried by top and bottom horizontal shafts 104 and 106, respectively. Shafts 104 and 106 are mounted in a frame 114 which is fastened to circular support 22 of platform 20.

Chains 96 and 98 of vertical conveyor 94 are joined together by a fork elevator 108. Elevator 108 is provided with teeth or forks 108*a* (see FIG. 8) which are dimensioned to be able to pass through cutouts 48*a* in tray 48 of carriage 44.

When carriage 44 is in the position shown in FIG. 7, the rotation of chains 94 and 96 brings elevator 108 through tray 48 of carriage 44 until it makes contact with the bottom brick in the stack 86 lying on said carriage. Carriage 44 is then lowered, and stack of bricks 86 remains on elevator 108. Motor 102, under the action of its automatic control program, drives conveyor 94 until the top brick in stack 86 is level with the rotatable table 24. This is shown in broken lines in the case of the stack 86' on the left hand side of the axis 0 of FIG. 7. In this position, the top brick is accessible to robot 34. Motor 102 then continues to operate vertical conveyor 94 step by step to raise the elevator 108 each time by a height corresponding to the thickness of a brick until the elevator is in the position indicated by reference numeral 110. At this point, it presents the last brick to robot 34. During this step-by-step raising of elevator 108, carriage 44 has sufficient time to g to pick up a new stack of bricks of the same type from the depalletization station.

It will be appreciated by one skilled in the art that if handling robot 34 is designed to lay a pair of superimposed bricks each time, each successive movement of elevator 108 may correspond to the thickness of two bricks.

As shown in FIG. 7, top shaft 104 of vertical conveyor 94 is housed in a slot 112 in its frame 114. This enables conveyor 94 to pivot slightly about its bottom shaft 106, to the extent of an angle determined by the depth of slot 112. This pivoting is brought about by a jack or motor 116 fixed on frame 114 or on support 22. The purpose of this is to pivot conveyor 94 slightly in the clockwise direction when stack 86 is transferred from carriage 44 to elevator 108. This prevents the bricks from falling off at the moment of instability which occurs on the transfer of the stack of bricks 86.

The vertical conveyor associated with hoist 58 is similar to vertical conveyor 94 described above and operates in the same way.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An apparatus for lining the inside wall of a vessel with bricks comprising a work platform vertically displaceable inside the vessel and capable of rotating about a vertical axis of the vessel, first robot means on the work platform for handling and laying the bricks, at least one hoist means, the hoist means comprising a plurality of telescopic sections and carriage means for lifting the bricks from a depalletization station positioned below the work platform up to the level of the work platform, and a depalletization second robot means whose action is coordinated with that of the first robot means in order to transfer the bricks from a reserve on a plurality of pallets onto the carriage means of the hoist and further including:

carrier tray means on said carriage means for receiving a stack of a plurality of bricks of the same type; and at least one vertical conveyor means associated with said hoist means, said vertical conveyor means being positioned at the level of said work platform, said vertical conveyor means taking the stack of bricks from said hoist means and raising said stack of bricks to the level of the work platform within the reach of said first robot means.

2. The apparatus of claim 1 including a plurality of hoists and wherein:

said hoists are disposed facing one another and said bricks are disposed in the longitudinal direction of said carriage means parallel to the vertical plane of symmetry of said hoist means.

3. The apparatus of claim 1 wherein said vertical conveyor means comprises:

endless chain means connected by fork elevator means, said fork elevator means having teeth which pass through corresponding cutouts in said carrier tray means of said carriage means.

4. The apparatus of claim 3 including:

stepping motor means for driving said endless chain means, said stepping motor means periodically operating said vertical conveyor means wherein said chain means travels over a step length corresponding to at least one brick thickness.

5. The apparatus of claim 3 including:

bottom sprocket means associated with said endless chain means wherein said vertical conveyor means is mounted so as to pivot about the axis of said bottom sprocket means.

6. The apparatus of claim 1 wherein said hoist means comprises:

two groups of adjacent telescopic rail means, said telescopic rail means having a circular cross-section, each rail of said rail means fitting into one another by lateral lug means provided on at least one of said rail means, said lug means mating with and sliding in corresponding profiled guide slot means in said rail means which are free of said lug means, said lug means mating with said slot means.

7. The apparatus of claim 6 wherein each of said carriage means includes:

top roller means and bottom roller means.

* * * * *